United States Patent [19]

Howard

[11] Patent Number: 4,578,681

[45] Date of Patent: Mar. 25, 1986

[54] METHOD AND APPARATUS FOR OPTIMIZING FEEDHORN PERFORMANCE

[75] Inventor: H. Taylor Howard, San Andreas, Calif.

[73] Assignee: Chaparral Communications, Inc., San Jose, Calif.

[21] Appl. No.: 506,494

[22] Filed: Jun. 21, 1983

[51] Int. Cl.[4] ..... H01Q 13/02; H01Q 13/06

[52] U.S. Cl. ..... 343/786; 343/840

[58] Field of Search ..... 343/772, 786, 840

[56] References Cited

U.S. PATENT DOCUMENTS

| | | | |
|---|---|---|---|
| 3,434,146 | 3/1969 | Petrich | 343/772 |
| 3,553,707 | 1/1971 | Yang et al. | 343/840 |
| 3,815,139 | 6/1974 | Lewis et al. | 343/786 |
| 4,338,609 | 7/1982 | Landry | 343/786 |

FOREIGN PATENT DOCUMENTS

| | | | |
|---|---|---|---|
| 708614 | 5/1954 | United Kingdom | 343/779 |

*Primary Examiner*—Eli Lieberman

*Attorney, Agent, or Firm*—F. D. LaRiviere

[57] ABSTRACT

An optimized feedhorn comprising a circular waveguide having a corrugated plate disposed around the outside of the aperture of the waveguide wherein the corrugations of the plate are capacitive as to E plane signals. The feedhorn includes a reduced aperture diameter which selectively protrudes beyond the plane of the corrugated plate. The amount of protrusion of the aperture is determined to approximately equalize E and H plane beamwidths and selectively shape the top and skirts of the signal pattern around the center frequency of interest.

16 Claims, 7 Drawing Figures

METHOD AND APPARATUS FOR OPTIMIZING FEEDHORN PERFORMANCE

BACKGROUND AND SUMMARY OF THE INVENTION

In the design of antennas for communications satellite systems, there are several important design considerations. The desired antenna should provide maximum signal gain, introduce minimum noise into the system and exhibit relatively low side-lobe signal levels. Such receiving antennas typically utilize a prime focus feedhorn to illuminate a parabolic reflector so as to achieve the best compromise among the listed design considerations.

To provide maximum signal gain, uniform illumination across the entire parabolic reflector is desirable but conflicts with the requirement for minimum noise and low side-lobe levels which demand a highly tapered illumination. Tapered illumination refers to illumination of the center of the reflector and utilizing the outer edge of the reflector as a shield from thermal noise radiated from earth.

Theoretically, the minimum noise and maximum gain requirements of antenna design can be met by uniformly illuminating the parabolic reflector with a feedhorn which emits a signal having infinitely steep side boundaries of its signal pattern hereafter "skirts"). Practically, such illumination can only be approached by selecting a parabolic reflector having a focal length to diameter ratio (f/D) matched to the performance of an optimized feedhorn.

To optimize carrier (signal)-to-noise ratio (C/N), consideration must be given to the amplifier to which the feedhorn is coupled. While ten years ago, very high temperature amplifiers (on the order of 600 Kelvin (K.)) were used, commonly 100 K. are now the industry standard with 75 K. units becoming available.

One well-known prior art feedhorn available on the market today maximizes C/N on a 0.375 f/D antenna using a 120 K. amplifier. The feedhorn comprises a circular waveguide having a corrugated plate disposed around the outside of the aperture at one end of the waveguide and including a $\frac{1}{4}$ wave transformer at the other end of the waveguide for impedance matching and coupling to the amplifier. See for example, U.S. patent applications Ser. Nos. 271,815 or 322,446, now U.S. Pat. No. 4,414,516, filed by the inventor and assigned to the assignee hereof, and incorporated by reference as if fully set forth herein. Such a feedhorn provides relatively uniform illumination across the parabolic reflector, its characteristic signal over the bandwidth of interest having relatively steep skirts and a substantially flat top by properly selecting the diameter of the circular waveguide for the center frequency of interest, and by properly locating the corrugated plate with respect to the outside of the aperture of the waveguide.

With advances in amplifier technology, the need for further advancement of antenna technology is clear. Broad bandwidth and wide beamwidth for uniform illumination of the parabolic reflector and steep side skirts of the emitted signal pattern is required to meet improved amplifier performance. The ideal signal pattern is flat-topped, having infinitely steep skirts. Furthermore, the pattern should be approximately equal (symmetrical) in the E and H planes which are orthogonal to each other.

E and H plane symmetry is desirable because most communications satellites in use today emit two orthogonal signals which must be received. To achieve E and H plane symmetry the aperture of the feedhorn in the E plane should be smaller than that in the H plane. This configuration arises because the electric field of the H plane is sinusoidally distributed across the diameter of the waveguide and there is no current in the sidewalls of the waveguide. However, the electric field of the E plane causes current to flow in the sidewalls of the waveguide which, upon reaching the aperture, flows down the outside of the waveguide and makes the aperture appear larger. Thus, by reducing the E plane dimension appropriately, the critically equivalent apertures for approximately equal E and H plane beamwidths are produced.

A circular waveguide is used in most present-day feedhorns because it is the most convenient way to receive the two orthogonal signals transmitted by communications satellites. However, obviously it is not possible to reduce only E plane beamwidths by reducing the aperture of a circular waveguide in one dimension without simultaneously affecting the other dimension which affects H plane beamwidth.

It is well understood that signal beamwidth can be controlled by changing aperture size. The smaller the aperture, the wider the pattern for both the E and H plane beamwidths. It is also well understood that beamwidth can be controlled by adding a plate around the aperture of the circular waveguide of the feedhorn, such plates having various configurations, sizes and location behind the aperture. Depending on location, the aperture of the circular waveguide appears to protrude beyond the plane of the plate.

Location of the plate with respect to the aperture primarily affects the E plane beamwidth since it is interacts with the current flowing down the outside of the waveguide. When the current reaches the plate, it is reflected back toward the aperture. If that current is at the proper amplitude and in the proper phase when re-introduced at the aperture, it augments the signal pattern emitted by the feedhorn. An equivalent explanation found in the literature refers to excitation of higher order modes which reinforce the principal TE11 mode in the waveguide.

If the diameter of the aperture of the circular waveguide is reduced by decreasing the diameter of the waveguide along its entire length, severe impedance mismatch is produced. To overcome that impedance mismatch at the center frequency of interest, the circular waveguide must be lengthened substantially. The longer the waveguide, the more unwieldy the feedhorn is to mount, rotate or otherwise conveniently use. According to the present invention, however, H plane signal beamwidth can be controlled by reducing the diameter of the circular waveguide just at the aperture by insertion of a small annular iris. Impedence match of the feedhorn is thus only slightly compromised.

In practice, location of the plate around the aperture affects both the E and H plane signal patterns. The effect is greater for the E plane than for the H plane, which is expected because of the E plane current flowing in the walls of the waveguide.

A feedhorn constructed in accordance with the principles of the present invention comprises a circular waveguide having a corrugated plate disposed around the outside of the aperture of the waveguide wherein the corrugations of the plate are capacitive as to E plane signals. In addition, the feedhorn of the present invention includes a reduced aperture diameter which selectively protrudes beyond the plane of the corrugated plate. The amount of protrusion of the aperture is determined to approximately equalize E and H plane beamwidths and selectively shape the top and skirts of signal pattern around the center frequency of interest. Aperture diameter is reduced primarily to control H-plane beamwidth for uniform illumination across the entire area of the parabolic reflector.

DESCRIPTION OF THE PREFERRED EMBODIMENT

Figure 1B:
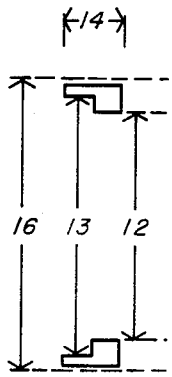
FIG. 1*b* is a sectional view at A—A of the annular iris of FIG. 1*a*.
Figure 1A:
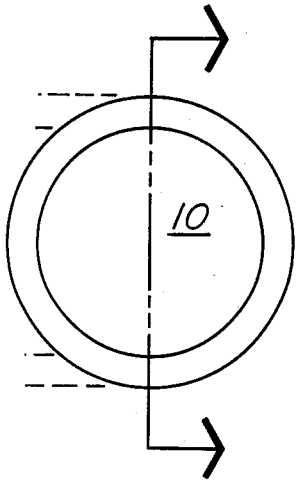
FIG. 1*a* is a top view of the annular iris constructed according to the principles of the present invention.
Figure 2A:
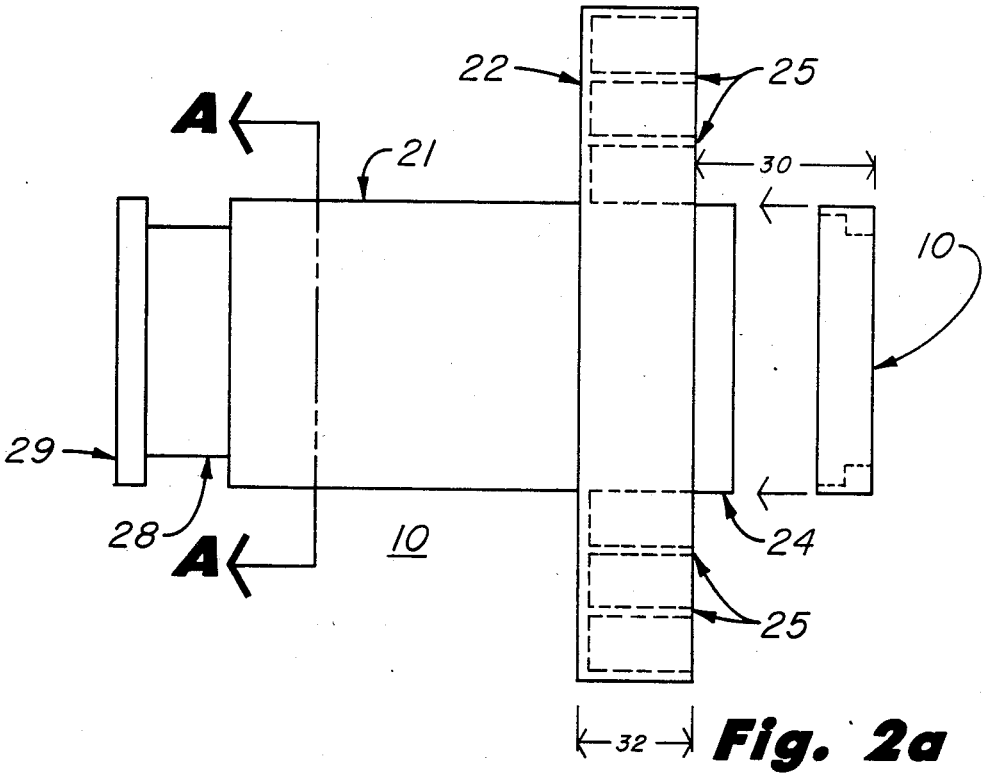
FIG. 2*a* is an exploded sideview of a feedhorn incorporating a corrugated plate and the annular iris of FIGS. 1*a* and B according to the present invention.
Figure 2B:
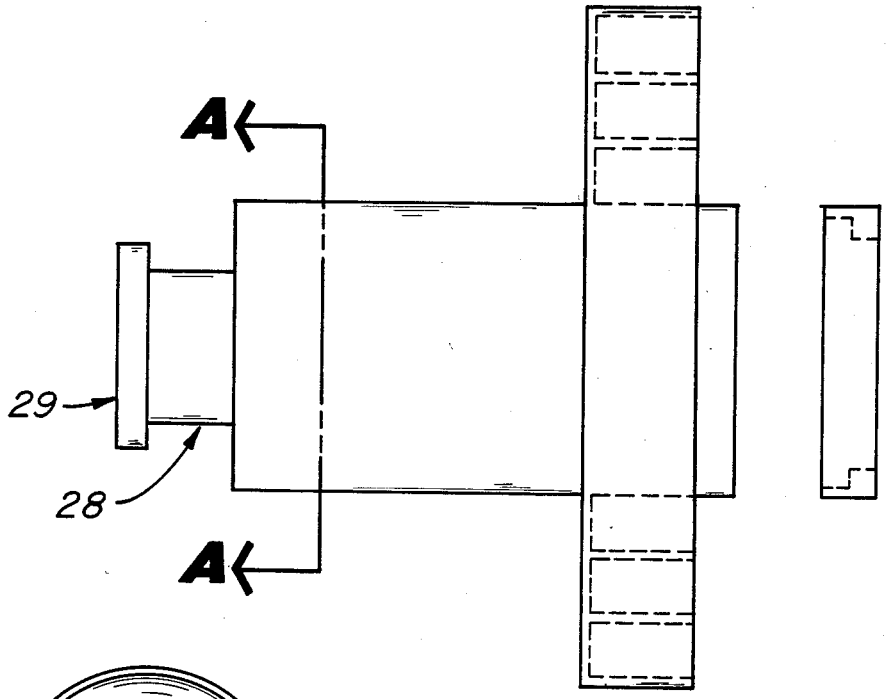
FIG. 2*b* is an exploded side view of the feedhorn of FIG. 2*a* rotated 90° about its longitudinal axis.
Figure 2C:
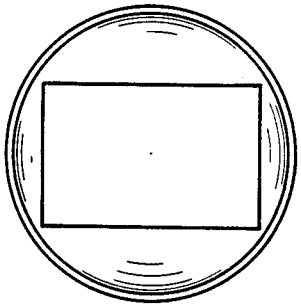
FIG. 2*c* is a front end view of the feedhorn of FIG. 2*a* at section A—A.
Figure 2D:
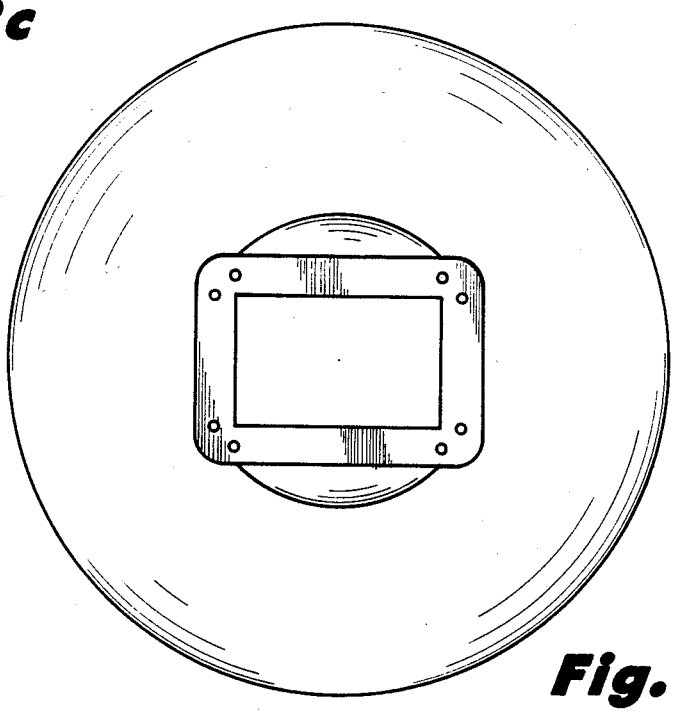
FIG. 2*d* is a rear end view of the feedhorn of FIG. 2*a*.

Referring to FIGS. 1*a* and 1*b*, annular iris 10 according to the preferred embodiment of the present invention is shown having outside diameter 16 inside diameter 12 at its aperture end and longitudinal dimension 14. Inside diameter 13, which is larger than aperture diameter 12 and smaller than outside diameter 16, can be equal to aperture diameter 12 for small values of longitudinal dimension 14.

Referring now to FIGS. 2*a*–2*d*, outside diameter 16 of annular iris 10 is slightly less than the inside diameter of the circular waveguide portion of prime focus feedhorn 20 to provide interference fit as iris 10 is inserted therein. While the interference fit may be sufficient to affix iris 10 to circular waveguide 21, it may be necessary to secure it by using conductive glue, solder, braze or other means for assuring attachment.

Annular iris 10 and feedhorn 20 are both made of aluminum or other suitable material which can withstand environmental conditions likely to be encountered and provide the electrical compatibility with the system. While not required, annular iris 10 and feedhorn 20 should be constructed of the same material to avoid electrical and electrochemical incompatibilities which may arise from using two different materials. It should be noted termination of feedhorn 20 at the other end of circular waveguide 21 is at quarterwave transformer 28, a well-known impedance matching device for circular waveguide. Rectangular Flange 29 provides customary mechanical coupling to TEM mode waveguide and, it should be an appropriate impedance matching structure or equivalent.

Corrugated plate 22 includes corrugations formed by rings concentric with aperture 24, shown typically at 25. Preferably, the corrugations are greater than $\frac{1}{4}$ wavelength in depth and there are at least 3 of them. By constructing the corrugations deeper than $\frac{1}{4}$ wavelength, typically $\frac{5}{8}$ wavelength or more, a capacitive reactance is presented to E-plane current flowing on the outside of the feedhorn walls. In addition, the frequency response of feedhorn 20 is approximately flat, less than ±1 dB, over a broad range of frequencies, e.g. ±0.5 gHz, around the center frequency of interest. Thus, the performance of the feedhorn of the present invention is essentially frequency independent around its center frequency.

Dimension 30 refers to the amount in inches of aperture protrusion beyond corrugated plate 22. Feedhorn 20 may include some fixed aperture protrusion such as that shown at 24. Additional protrusion, making up the total protrusion for the feedhorn, is provided by iris 10 and amounts to slightly less than dimension 14, since some of that dimension is consumed when iris 10 is inserted into feedhorn 20 at its aperture 24.

Dimension 12 of annular iris 10 affects both E and H plane beamwidth. However, the effect is greater for the H plane pattern. Thus, as dimension 12 is reduced for a given center frequency, H plane beamwidth approaches E plane beamwidth.

Figure 3:
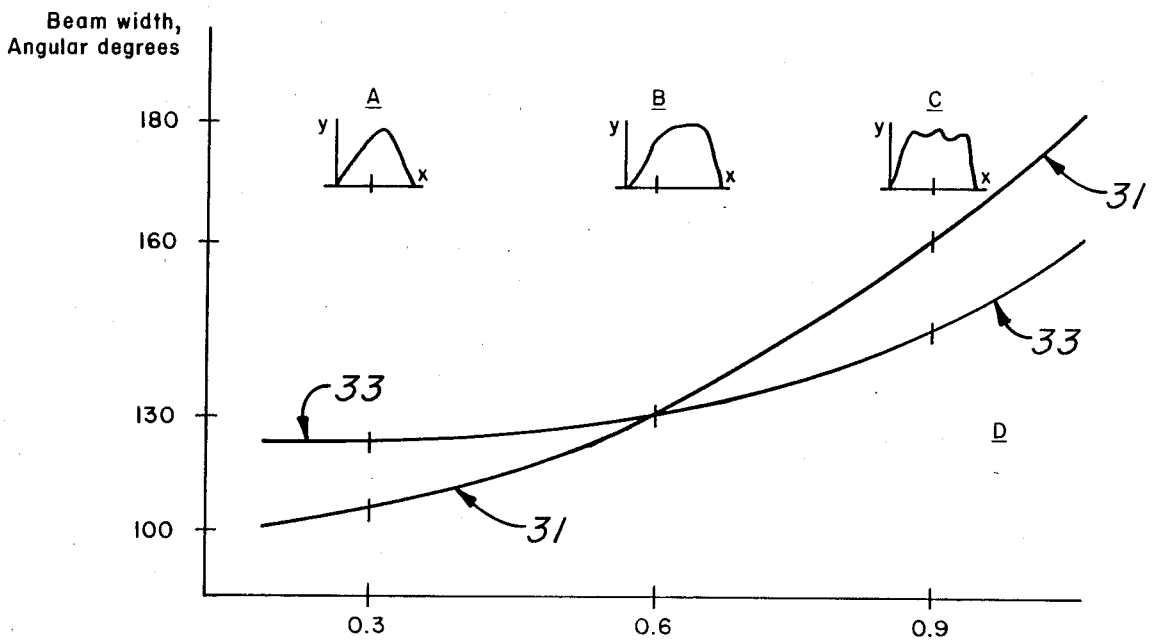
FIG. 3A–D is a graph of the effect on E and H field beamwidth as a function of aperture protrusion beyond the corrugated plate of prime focus feedhorns including the feedhorn of the present invention incorporating the annular iris of FIGS. 1A and 1B.

As protrusion 30 of feedhorn 20 becomes greater, the shape of the E plane signal pattern changes, having steeper skirts and a flatter top, as shown by the three E plane patterns inset above curves 31 and 33 in FIG. 3D. The progressive flattening and rippling of the top of a gradually widening E plane pattern in FIGS. 3A through 3C as aperture protrusion increases is caused by the change in interaction of the re-introduced E plane current with the primary signal at the aperture of the feedhorn. The behavior of H plane pattern is similar, but never becomes as flat on top at the wider beamwidths. The Y-axes of FIGS. 3A–C are in units of dB and the X-axes are in units of angular degrees.

Referring again to FIG. 3D, the intersection of curves 31 and 33 indicates approximately equalized E and H plane patterns are obtained for a beamwidth of 130° (0.36 f/D reflector) with an aperture protrusion of about 0.6″. The effect of the present invention, selectively reducing the aperture diameter and protruding it beyond a plate having capacitive corrugations, is to shift the intersection of curves 31 and 33 so that approximately equalized E and H plane patterns are obtained for a beamwidth of 160° (0.3 f/D reflector) with an aperture protrusion of about 0.9″. The improvement of system performance in a system utilizing a feedhorn according to the present invention with an 0.3 f/D reflector is reduced electrical noise, including such noise radiated from thermal sources, introduced into the system with corresponding improvement in C/N ratio.

At a center frequency of 3.95 gHz, a relatively flat-topped (less than ±1 dB ripple), steep-skirted signal pattern can be achieved utilizing a feedhorn incorporating a circular waveguide having an inside diameter of approximately 2.45″ and a protrusion of approximately 0.9″. For such configuration, dimension 16 of annular iris 10 is approximately 2.25″ and dimension 14 is approximately 0.2″, or about 1/20 to 1/10 wavelength. Such a feedhorn is optimized for operation with a parabolic reflector having f/D equal to 0.3.

Employing the principles of the present invention, annular irises can be designed to optimize feedhorn performance for parabolic reflectors having f/D ratios ranging from 0.5 down to 0.3. Substantial improvement in C/N ratio, on the order of 0.3 dB, is achievable by utilizing the shorter f/D reflector. Such improvement in C/N ratio is directly attributable to the lower noise introduced into the system by the antenna system since the beamwidth pattern of the signal illuminating the parabolic reflector is wider and has steeper skirts than previously achievable.

Protrusion of the aperture can be achieved more than one way. Corrugated plate 22 can be movably mounted (not shown) on circular waveguide 21 so that its distance from the aperture of the feedhorn can be varied simply by moving the plate along the circular waveguide as required. Conversely, corrugated plate 22 can be fixedly mounted or constructed as part of circular waveguide 21 with little or no protrusion at 24. In that configuration, protrusion dimension 30 would be primarily determined by dimension 14 of annular iris 10 which can be any amount necessary to achieve the desired performance characteristics at a given center frequency. For the configuration where protrusion dimension 30 is determined primarily by insertion of annular iris 10, the extent of inside diameter 13 in parallel with the the longitudinal axis of annular iris 10 may become significant. As mentioned elsewhere in this specification, impedance match of the feedhorn deteriorates as the amount of reduced diameter of the circular waveguide along its length increases. Thus, the length of diameter 13 may become significant as dimension 14 increases.

I claim:

1. Apparatus for optimizing performance of a feedhorn with a parabolic reflector in an antenna system, said feedhorn including a circular waveguide for receiving polarized signals at an aperture end, impedance matching means coupled to the other end and a corrugated plate disposed around the outside of the circular waveguide near the aperture end, said apparatus comprising an annular iris having an outside diameter approximately equal to the inside diameter of the circular waveguide for interference fit therewith, having an inside diameter determined by the desired beamwidth of the signal to be emitted therefrom, and having a longitudinal dimension selected to protrude beyond the corrugated plate of the feedhorn to approximately equalize the E and H plane beamwidths and selectively shape the signal patterns thereof.

2. Apparatus as in claim 1 wherein the corrugations of the corrugated plate provide a capacitive reactance near the aperture end of the circular waveguide at the center frequency of the signals received.

3. Apparatus as in claim 1 wherein the corrugations of the corrugated plate are deeper than one-quarter wavelength at the center frequency of the signals received.

4. Apparatus as in claim 1 wherein the inside diameter of the annular iris has a smaller section and a larger section, and the smaller section is selected for an E-plane beamwidth which is substantially equal to the corresponding H-plane beamwidth.

5. Apparatus as in claim 1 wherein the protrusion of the annular iris is selected for an E-plane signal pattern having the widest, flattest top and steepest skirts which is substantially equal to the corresponding H-plane signal pattern.

6. Apparatus as in claim 4 wherein the longitudinal extent of the smaller section of the inside diameter of the iris is substantially less than the longitudinal extent of the inside diameter of the circular waveguide.

7. Method for optimizing performance of a feedhorn with a parabolic reflector in an antenna system, said feedhorn including a circular waveguide for receiving polarized signals at an aperture end, impedance matching means coupled to the other end and a corrugated plate disposed around the outside of the circular waveguide near the aperture end, said method comprising the steps of:

reducing the inside diameter of the aperture end of said circular waveguide to a diameter determined by the desired H plane beamwidth of the signal to be emitted therefrom; and protruding the reduced diameter portion of the aperture end of said circular waveguide of the feedhorn beyond the corrugated plate in an amount equal to that required to approximately equalize the E and H plan beamwidths and to selectively shape the signal patterns thereof.

8. The method as in claim 7 wherein the corrugations of the corrugated plate provide a capacitive reactance near the aperture end of the circular waveguide at the center frequency of the signals received.

9. The method as in claim 7 wherein the corrugations of the corrugated plate are deeper than one-quarter wavelength at the center frequency of the signal received.

10. The method as in claim 7 further including the step of selecting the protrusion of the aperture end for an E-plane signal pattern having the widest, flattest top and steepest skirts which is substantially equal to the corresponding H-plane signal pattern.

11. The method as in claim 7 wherein the longitudinal extent of the inside diameter at the aperture end of the circular waveguide is substantially less than the longitudinal extent of the inside diameter of the circular waveguide.

12. A prime focus feedhorn comprising:

a circular waveguide, having a rear end, an aperture end and an inside diameter, for receiving polarized signals at the aperture end;

impedance matching means coupled to the rear end for transmitting received signals; and a plate disposed around the outside of the circular waveguide near the aperture end having corrugations formed by rings thereon concentric with the aperture end;

said aperture end having an inside diameter less than the inside diameter of the circular waveguide as determined by the desired H-plane beamwidth of the signal to be emitted therefrom, and protruding beyond the corrugations of the plate to approximately equalize the E and H plane beamwidths and selectively shape the signal patterns thereof.

13. A feedhorn as in claim 12 wherein the corrugations provide a capacitive reactance near the aperture end at the center frequency of the signals received.

14. A feedhorn as in claim 12 wherein the corrugations are deeper than one-quarter wavelength at the center frequency of the signals recieved.

15. A feedhorn as in claim 12 wherein the longitudinal extent of the inside diameter of the aperture end is substantially less than the longitudinal extent of the inside diameter of the circular waveguide.

16. A feedhorn as in claim 12 wherein the protrusion of the aperture end is selected for an E-plane signal pattern having the widest, flattest top and steepest skirts which is substantially equal to the corresponding H-plane.

* * * * *